US009707674B2

(12) United States Patent
Liu et al.

(10) Patent No.: US 9,707,674 B2
(45) Date of Patent: Jul. 18, 2017

(54) CYLINDER COVER FOR STEAM POWERED NAILING GUNS

(71) Applicant: Taizhou Dajiang Ind. Co., Ltd., Wenling, Zhejiang Province (CN)

(72) Inventors: Gui-Wen Liu, Wenling (CN); Ming-Jun Yang, Wenling (CN); Jin-Quan Huang, Wenling (CN)

(73) Assignee: TAIZHOU DAJIANG IND. CO., LTD., Wenling, Zhejiang Province (CN)

( * ) Notice: Subject to any disclaimer, the term of this patent is extended or adjusted under 35 U.S.C. 154(b) by 489 days.

(21) Appl. No.: 14/550,607

(22) Filed: Nov. 21, 2014

(65) Prior Publication Data

US 2016/0023338 A1 Jan. 28, 2016

(30) Foreign Application Priority Data

Jul. 24, 2014 (CN) ..... 2014 1 0355313
Jul. 24, 2014 (CN) ..... 2014 2 0410893

(51) Int. Cl.
*B25C 1/04* (2006.01)
*B25F 5/02* (2006.01)
(Continued)

(52) U.S. Cl.
CPC ..... *B25C 1/042* (2013.01); *B25C 1/04* (2013.01); *B25F 5/02* (2013.01); *B25C 1/00* (2013.01); *B25D 9/14* (2013.01)

(58) Field of Classification Search
CPC .. B25C 1/00; B25C 1/04; B25C 1/042; B25C 1/105; B25D 9/14; B25D 9/20; B25F 5/02
(Continued)

(56) References Cited

U.S. PATENT DOCUMENTS 2,987,047 A 6/1961 Horace
3,050,732 A * 8/1962 Termet ..... B25C 1/105 227/10
(Continued)

FOREIGN PATENT DOCUMENTS

CN 1582214 A 2/2005
CN 204025225 U 12/2014
CN 204525370 U 8/2015

OTHER PUBLICATIONS

State Intellectual Property Office of the P.R. China (ISR/CN), "International Search Report for PCT/CN2015/082160", China, Sep. 15, 2015.

*Primary Examiner* — Scott A. Smith
(74) *Attorney, Agent, or Firm* — Tim Tingkang Xia, Esq.; Locke Lord LLP

(57) ABSTRACT

The invention relates to a cylinder cover for a cylinder of a piston mechanism. In certain embodiments, the cylinder cover includes a cylinder cover body, a valve plate, and a one-directional valve. The cylinder cover body has an exhaust port, and an oil intake. The exhaust port and oil intake are disposed on outer circumference of the cylinder cover body. The one directional oil valve is formed by a compression spring and a ball. An inner end of the oil intake is connected to the compression spring through the ball and the ball is disposed between one end of the compression spring and the inner end of the oil intake. The valve plate is retained on an inner wall of the cylinder cover body by a retaining nut. The cylinder cover further has an auxiliary heating rod inside cylinder cover body for pre-heating cylinder cover to a predetermined temperature.

20 Claims, 3 Drawing Sheets

(51) Int. Cl.
*B25D 9/14* (2006.01)
*B25C 1/00* (2006.01)

(58) Field of Classification Search
USPC .... 227/10, 130, 140, 142; 173/15, 206, 168, 173/169, 114; 91/309, 317, 325, 342; 60/371, 565, 581
See application file for complete search history.

(56) References Cited

U.S. PATENT DOCUMENTS

| | | | | | |
|---|---|---|---|---|---|
| 3,803,840 | A * | 4/1974 | Toczycki | B25C 1/00 | 227/130 |
| 4,040,164 | A * | 8/1977 | Briles | B25C 1/04 | 227/130 |
| 4,811,881 | A * | 3/1989 | Heck | B21J 15/105 | 227/112 |
| 5,417,294 | A * | 5/1995 | Suher | B25D 9/14 | 173/15 |
| 6,161,628 | A * | 12/2000 | Liu | B25D 9/20 | 173/114 |
| 6,902,011 | B2 * | 6/2005 | Hall | B25B 23/1453 | 173/168 |
| 7,194,859 | B1 * | 3/2007 | Sawdon | F15B 11/0325 | 60/565 |
| 7,407,070 | B2 * | 8/2008 | Hezeltine | B25C 1/04 | 227/10 |
| 7,959,415 | B2 * | 6/2011 | Schuetzle | F04B 1/0404 | 417/273 |
| 8,074,736 | B2 * | 12/2011 | Sun | B25F 5/02 | 173/218 |
| 2007/0283941 | A1 | 12/2007 | Tai et al. | | |
| 2012/0097730 | A1 | 4/2012 | Liang et al. | | |

* cited by examiner

CYLINDER COVER FOR STEAM POWERED NAILING GUNS

CROSS-REFERENCE TO RELATED APPLICATIONS

This application claims the priority to Chinese Patent Application Nos. 201410355313.9 and 201420410893.2, both filed on Jul. 24, 2014, in the State Intellectual Property Office of People's Republic of China, which are incorporated herein in their entireties by reference.

FIELD

The present invention mainly relates to the field of nail driving tool, and more particularly to embodiments of cylinder cover for steam powered nailing gun and steam powered nailing guns having the cylinder cover.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Currently, compressed air serves as a power source in most nailing guns. When compressed air is used, an air inlet pipe is required to be connected to a body of a nail gun, and pulling and handling the air inlet pipe make such nailing gun difficult to use. In addition, a user usually needs to wear protective earplugs because noise is relatively loud while using such nailing gun powered by compressed air. Moreover, an air compressor is required to provide compressed air. Since the air compressor is bulky, and heavy, the air compressor is difficult to carry from one work site to another work site. The air compressor itself is also costly.

Conventional nailing guns may also use electricity or rechargeable battery as power sources. However, a nail gun requires a strong instantaneous force. Such a strong instantaneous force requires a very high instantaneous current, and the very high instantaneous current may cause coils and batteries to become overheat very easily. Therefore, the duration of its normal use is limited, and the operational lifespan of such a nailing gun is shortened.

Other power sources may also be used in nail guns, such as natural gas or other combustive fuel gas. However, for a nailing gun powered by combustive fuel gas, its structure is rather complex, its failure rate and cost are both high, it is very heavy, and difficult to operate. Not only the combustive fuel gas is expensive, but also the transportation of such gas is a safety hazard.

Therefore, a design of using a cylinder to compress air is adopted in some products, and such a design requires airtightness of a cylinder cover. Problems such as insufficient pressure occur when air is leaked. Meanwhile, in a cold weather, a compression method is undesirable and not very efficient due to cold air, and it is difficult to maintain desired air pressure.

Therefore, heretofore unaddressed needs exist in the art to address the aforementioned deficiencies and inadequacies.

SUMMARY

The present invention relates to a steam powered nailing gun. The steam powered nailing gun uses a high pressure steam as power source, and overcomes defects that the nailing gun powered by an air compressor has a large size, and very heavy, an electric nailing gun has short service life, and a nailing gun powered by gas is expensive and dangerous.

In one aspect, the present invention relates to a cylinder cover for a piston mechanism. The piston mechanism is used in steam powered nailing guns and the piston mechanism includes a cylinder cover. In certain embodiments, the cylinder cover includes: a cylinder cover body, a valve plate, and a one-directional oil valve. The cylinder cover body has an exhaust port, and an oil intake. The exhaust port and the oil intake are disposed on the outer circumference of the cylinder cover body. The one directional oil valve is formed by a compression spring and a ball. An inner end of the oil intake is connected to the compression spring through the ball, and the ball is disposed between a first end of the compression spring and the inner end of the oil intake.

In certain embodiments, the compression spring and the ball are movable synchronously. The diameter of the compression spring is greater than the inner diameter of the oil intake. The diameter of the ball is greater than the inner diameter of the oil intake. The oil is allowed to flow only in one direction from the outside to the inside of the cylinder cover body at a predetermined oil pressure that pushes the ball inward against the resilient force of the compression spring.

In certain embodiments, the valve plate is retained on an inner wall of the cylinder cover body by a retaining nut. The valve plate is located above an exhaust opening and is used to open or close the exhaust opening. When the valve plate is in an open state, the valve plate does not block the exhaust opening. When the valve plate is in a closed state under increased air pressure in the cylinder, the valve plate blocks the exhaust opening.

In certain embodiments, the cylinder cover includes an auxiliary heating rod inside the cylinder cover body. The auxiliary heating rod is used to pre-heat the cylinder cover to a predetermined temperature.

In another aspect, the present invention relates to a steam powered nailing gun. The steam powered nailing gun has a piston mechanism and the piston mechanism has a cylinder cover. In certain embodiments, the cylinder cover includes: a cylinder cover body, a valve plate, and a one-directional oil valve. The cylinder cover body has an exhaust port, and an oil intake. The exhaust port and the oil intake are disposed on the outer circumference of the cylinder cover body. The one directional oil valve is formed by a compression spring and a ball. An inner end of the oil intake is connected to the compression spring through the ball, and the ball is disposed between a first end of the compression spring 8 and the inner end of the oil intake.

In certain embodiments, the compression spring and the ball are movable synchronously. The diameter of the compression spring is greater than the inner diameter of the oil intake. The diameter of the ball is greater than the inner diameter of the oil intake. The oil is allowed to flow only in one direction from the outside to the inside of the cylinder cover body at a predetermined oil pressure that pushes the ball inward against the resilient force of the compression spring.

In certain embodiments, the valve plate is retained on an inner wall of the cylinder cover body by a retaining nut. The valve plate is located above an exhaust opening and is used to open or close the exhaust opening. When the valve plate is in an open state, the valve plate does not block the exhaust opening. When the valve plate is in a closed state under increased air pressure in the cylinder, the valve plate blocks the exhaust opening.

In certain embodiments, the cylinder cover includes an auxiliary heating rod inside the cylinder cover body. The auxiliary heating rod is used to pre-heat the cylinder cover to a predetermined temperature.

These and other aspects of the present invention will become apparent from the following description of the preferred embodiment taken in conjunction with the following drawings, although variations and modifications therein may be effected without departing from the spirit and scope of the novel concepts of the invention.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment. The drawings do not limit the present invention to the specific embodiments disclosed and described herein. The drawings are not necessarily to scale, emphasis instead being placed upon clearly illustrating the principles of the invention, and wherein.

DETAILED DESCRIPTION

Figure 1:
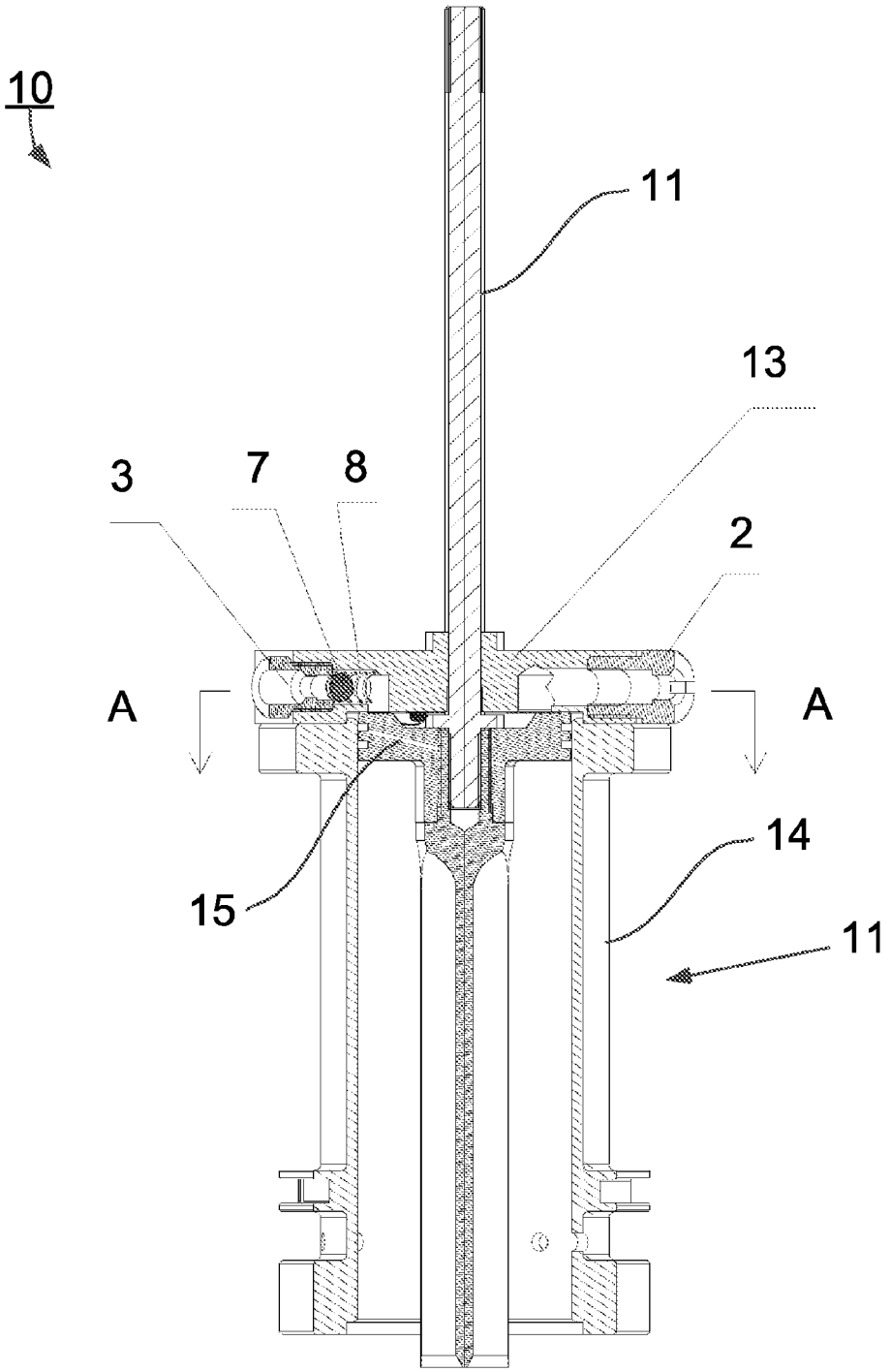
FIG. 1 is a cross sectional view of the piston mechanism for a steam powered nailing gun according to certain embodiments of the present invention.

The present invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom", "upper" or "top," and "front" or "back" may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around", "about" or "approximately" shall generally mean within 20 percent, preferably within 10 percent, and more preferably within 5 percent of a given value or range. Numerical quantities given herein are approximates, meaning that the term "around", "about" or "approximately" can be inferred if not expressly stated.

Many specific details are provided in the following descriptions to make the present invention be fully understood, but the present invention may also be implemented by using other manners different from those described herein, so that the present invention is not limited by the specific embodiments disclosed in the following.

The description will be made as to the embodiments of the present invention in conjunction with the accompanying drawings FIGS. 1-3. In accordance with the purposes of this invention, as embodied and broadly described herein, this invention, in one aspect, relates to a cylinder cover of a piston mechanism 10 for a steam powered nailing gun.

Referring now to FIG. 1, a cross sectional view of the piston mechanism 10 for a steam powered nailing gun is shown according to certain embodiments of the present invention.

In certain embodiments, the piston mechanism 10 includes a piston cylinder 11, and a pull rod 12. The piston cylinder 11 has a cylinder cover 13, a cylinder body 14, and a piston plate 15. The cylinder cover 13 is disposed above the cylinder body 14. The piston plate 15 is disposed inside the cylinder body 14. A lower end of the piston plate 15 is connected to a firing pin 51 of a nail magazine through threads.

Figure 2:
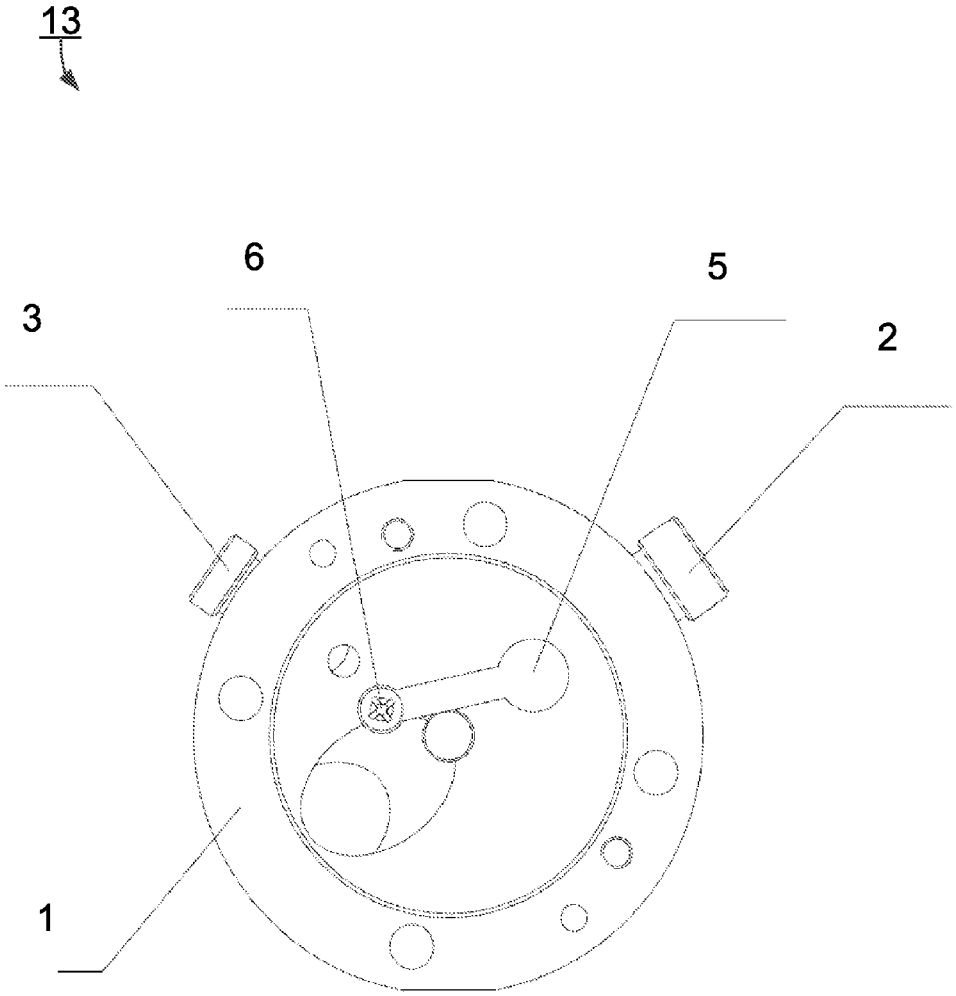
FIG. 2 is a schematic structural view of a cylinder cover of the piston mechanism as shown in FIG. 1 according to one embodiment of the present invention.
Figure 3:
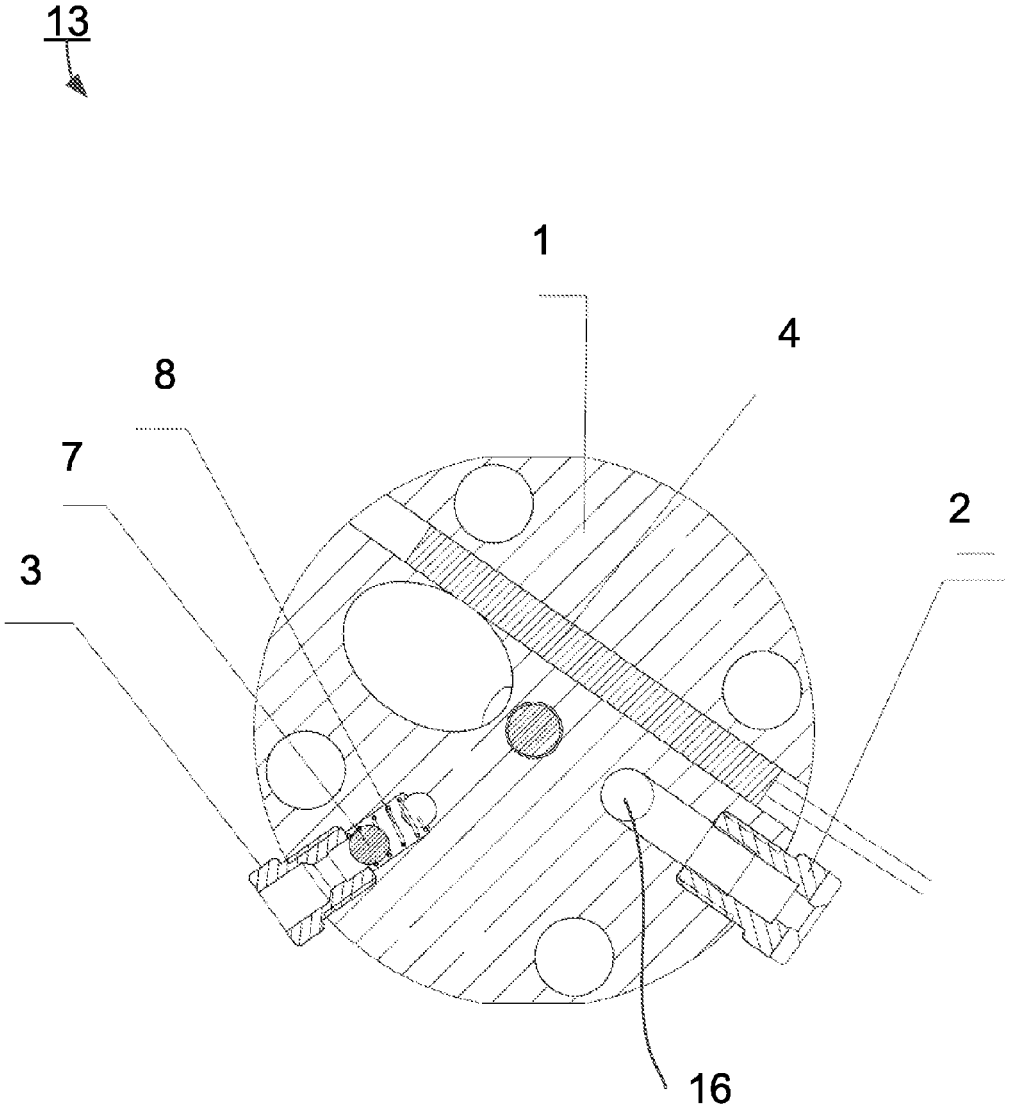
FIG. 3 is a schematic sectional view of the cylinder cover of the piston mechanism along a plane A-A as shown in FIG. 1 according to one embodiment of the present invention.

In certain embodiments, as shown in FIG. 2 and FIG. 3, the cylinder cover 13 has a cylinder cover body 1, a valve plate 5, and a one-directional valve. The cylinder cover body 1 has an exhaust port 2, and an oil intake 3. The exhaust port 2 and the oil intake 3 are disposed on the outer circumference of the cylinder cover body 1. The one directional oil valve is formed by a compression spring 8 and a ball 7. An inner end of the oil intake 3 is connected to the compression spring 8 through the ball 7, and the ball 7 is disposed between a first end of the compression spring 8 and the inner end of the oil intake 3.

When no oil is filled, the ball 7 seals an inner end opening of the oil intake 3 at the resilient force of the compression spring 8. When oil is filled, oil pressure pushes the ball 7 inward to open the oil filling channel. Once oil filling is completed, the compression spring 8 pushes the ball 7 back to towards the oil intake 3, and seals the inner end opening of the oil intake 3. The one directional oil intake 3 ensures that lubricant in the piston cylinder 11 does not flow out, and high-pressure air does no leak.

In certain embodiments, the compression spring 8 and the ball 7 of the one-directional valve are movable synchronously. In one embodiment, the diameter of the compression spring 8 is greater than the inner diameter of the oil intake 3. In another embodiment, the diameter of the compression spring 8 is less than the inner diameter of the oil intake 3. The diameter of the ball 7 is greater than the inner diameter of the oil intake 3. The oil is allowed to flow only in one direction from the outside to the inside of the cylinder cover body 1 at a predetermined oil pressure that pushes the ball 7 inward against the resilient force of the compression spring 8. Therefore, the oil intake 3 is one-directional.

In certain embodiments, the exhaust port 2 is connected to an exhaust opening 16. The valve plate 5 is retained on an inner wall of the cylinder cover body 1 by a retaining nut 6. The valve plate 5 is located above an exhaust opening and is used to open or close the exhaust opening. When the valve plate 5 is in an open state, the valve plate 5 does not block the exhaust opening 16. When the valve plate 5 is in a closed state under increased air pressure in the piston cylinder 11, the valve plate 5 blocks the exhaust opening 16. The exhaust opening 16 may be opened again when the increased pressure in the piston cylinder 11 disappears.

The air pressure inside the piston cylinder is reduced after steam expansion, and the valve plate 5 bounces to open the exhaust opening 16, so that the piston cylinder 11 exhausts dead steam. The valve plate 5 is sealed at a high pressure and is open at a low pressure. The valve plate 5 achieves the functions of high-pressure sealing and low-pressure exhaustion.

In certain embodiments, the cylinder cover includes an auxiliary heating rod 4 inside the cylinder cover body 1. The auxiliary heating rod 4 is used to pre-heat the cylinder cover to a predetermined temperature. The auxiliary heating rod 4 improves effect of steam compression, and increases the pressure inside the piston cylinder 11. Cold weather usually causes air pressure in the piston cylinder 11 to become insufficient. Therefore when the weather is cold, the auxiliary heating rod 4 increases air pressure inside the piston cylinder 11.

In another aspect, the present invention relates to a steam powered nailing gun. In certain embodiments, as shown in FIG. 1, the steam powered nailing gun has a piston mechanism 10 and the piston mechanism 10 includes a piston cylinder 11 and a pull rod 12. The piston cylinder 11 has a cylinder cover 13, a cylinder body 14, and a piston plate 15. The cylinder cover 13 is disposed above the cylinder body 14. The piston plate 15 is disposed inside the cylinder body 14. A lower end of the piston plate 15 is connected to a firing pin 51 of a nail magazine through threads.

In certain embodiments, as shown in FIG. 2 and FIG. 3, the cylinder cover 13 has a cylinder cover body 1, a valve plate 5, and a one-directional valve. The cylinder cover body 1 has an exhaust port 2, and an oil intake 3. The exhaust port 2 and the oil intake 3 are disposed on the outer circumference of the cylinder cover body 1. The one directional oil valve is formed by a compression spring 8 and a ball 7. An inner end of the oil intake 3 is connected to the compression spring 8 through the ball 7, and the ball 7 is between a first end of the compression spring 8 and the inner end of the oil intake 3.

When no oil is filled, the ball 7 seals an inner end opening of the oil intake 3 at the resilient force of the compression spring 8. When oil is filled, oil pressure pushes the ball 7 inward to open the oil filling channel. Once oil filling is completed, the compression spring 8 pushes the ball 7 back to towards the oil intake 3, and seals the inner end opening of the oil intake 3. The one directional oil intake 3 ensures that lubricant in the piston cylinder 11 does not flow out, and high-pressure air does no leak.

In certain embodiments, the compression spring 8 and the ball 7 of the one-directional valve are movable synchronously. In one embodiment, the diameter of the compression spring 8 is greater than the inner diameter of the oil intake 3. In another embodiment, the diameter of the compression spring 8 is less than the inner diameter of the oil intake 3. The diameter of the ball 7 is greater than the inner diameter of the oil intake 3. The oil is allowed to flow only in one direction from the outside to the inside of the cylinder cover body 1 at a predetermined oil pressure that pushes the ball 7 inward against the resilient force of the compression spring 8. Therefore, the oil intake 3 is one-directional.

In certain embodiments, the exhaust port 2 is connected to an exhaust opening 16. The valve plate 5 is retained on an inner wall of the cylinder cover body 1 by a retaining nut 6. The valve plate 5 is located above the exhaust opening 16 and is used to open or close the exhaust opening 16. When the valve plate 5 is in an open state, the valve plate 5 does not block the exhaust opening 16. When the valve plate 5 is in a closed state under increased air pressure in the piston cylinder 11, the valve plate 5 blocks the exhaust opening 16 to prevent air leakage, and to maintain proper pressure in the piston cylinder 11. The exhaust opening 16 may be opened again when the increased pressure in the piston cylinder 11 disappears.

The air pressure inside the piston cylinder is reduced after steam expansion, and the valve plate 5 bounces to open the exhaust opening 16, so that the piston cylinder 11 exhausts dead steam. The valve plate 5 is sealed at a high pressure and is open at a low pressure. The valve plate 5 achieves the functions of high-pressure sealing and low-pressure exhaustion.

In certain embodiments, the cylinder cover includes an auxiliary heating rod 4 inside the cylinder cover body 1. The auxiliary heating rod 4 is used to pre-heat the cylinder cover to a predetermined temperature. The auxiliary heating rod 4 improves effect of steam compression, and increases the pressure inside the piston cylinder 11. Cold weather usually causes air pressure in the piston cylinder 11 to become insufficient. Therefore when the weather is cold, the auxiliary heating rod 4 increases air pressure inside the piston cylinder 11.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims, the foregoing description and the exemplary embodiments described therein, and accompanying drawings.

What is claimed is:

1. A cylinder cover for a cylinder of a piston mechanism, comprising:

a cylinder cover body having an exhaust port, and an oil intake, wherein the exhaust port, and the oil intake are disposed on the outer circumference of the cylinder cover body;

a valve plate; and a one directional oil valve formed by a compression spring and a ball, wherein an inner end of the oil intake is connected to the compression spring through the ball, and the ball is disposed between a first end of the compression spring and the inner end of the oil intake.

2. The cylinder cover according to claim 1, wherein the compression spring and the ball are movable synchronously.

3. The cylinder cover according to claim 1, wherein the diameter of the compression spring is greater than the inner diameter of the oil intake.

4. The cylinder cover according to claim 1, wherein the diameter of the ball is greater than the inner diameter of the oil intake.

5. The cylinder cover according to claim 1, wherein the oil is allowed to flow only in one direction from the outside to the inside of the cylinder cover body at a predetermined oil pressure that pushes the ball inward against the resilient force of the compression spring.

6. The cylinder cover according to claim 1, the valve plate is retained on an inner wall of the cylinder cover body by a retaining nut.

7. The cylinder cover according to claim 1, further comprising an auxiliary heating rod inside the cylinder cover body.

8. The cylinder cover according to claim 7, wherein the auxiliary heating rod is used to pre-heat the cylinder cover to a predetermined temperature.

9. The cylinder cover according to claim 1, wherein the valve plate is located above an exhaust opening and the valve plate does not block the exhaust opening in an open state.

10. The cylinder cover according to claim 9, wherein the valve plate blocks the exhaust opening in a closed state under increased air pressure in the cylinder.

11. A steam powered nailing gun comprising a piston mechanism having a cylinder cover on a cylinder, wherein the cylinder cover includes:

a cylinder cover body having an exhaust port, and an oil intake, wherein the exhaust port, and the oil intake are disposed on the outer circumference of the cylinder cover body;

a valve plate; and a one directional oil valve formed by a compression spring and a ball, wherein an inner end of the oil intake is connected to the compression spring through the ball, and the ball is disposed between a first end of the compression spring and the inner end of the oil intake.

12. The steam powered nailing gun according to claim 11, wherein the compression spring and the ball are movable synchronously.

13. The steam powered nailing gun according to claim 11, wherein the diameter of the compression spring is greater than the inner diameter of the oil intake.

14. The steam powered nailing gun according to claim 11, wherein the diameter of the ball is greater than the inner diameter of the oil intake.

15. The steam powered nailing gun according to claim 11, wherein the oil is allowed to flow only in one direction from the outside to the inside of the cylinder cover body at a predetermined oil pressure that pushes the ball inward against the resilient force of the compression spring.

16. The steam powered nailing gun according to claim 11, the valve plate is retained on an inner wall of the cylinder cover body by a retaining nut.

17. The steam powered nailing gun according to claim 11, further comprising an auxiliary heating rod inside the cylinder cover body.

18. The steam powered nailing gun according to claim 17, wherein the auxiliary heating rod is used to pre-heat the cylinder cover to a predetermined temperature.

19. The steam powered nailing gun according to claim 11, wherein the valve plate is located above an exhaust opening and the valve plate does not block the exhaust opening in an open state.

20. The steam powered nailing gun according to claim 19, wherein the valve plate blocks the exhaust opening in a closed state under increased air pressure in the cylinder.

* * * * *